United States Patent [19]

Getgey et al.

[11] Patent Number: 4,459,056

[45] Date of Patent: Jul. 10, 1984

[54] DISPOSABLE PENCIL STRUCTURE AND METHOD OF SHARPENING PENCIL HEAD

[75] Inventors: William F. Getgey, 2191 Victory Pkwy., Cincinnati, Ohio 45206; John F. Mayer, 209 Rosemont, Ft. Thomas, Ky. 41075

[73] Assignees: Homer E. Gemmer, Highland Heights; John F. Mayer, Ft. Thomas, both of Ky.; William F. Getgey, Cincinnati, Ohio; Jack A. Wishard, Cincinnati, Ohio; John D. Henry, Cincinnati, Ohio; Robert B. Raines, Harnersville, Ohio

[21] Appl. No.: 13,247

[22] Filed: Feb. 21, 1979

Related U.S. Application Data

[63] Continuation-in-part of Ser. No. 937,328, Aug. 28, 1978, abandoned, which is a continuation-in-part of Ser. No. 868,180, Jan. 9, 1978, abandoned.

[51] Int. Cl.[3] ..... B43K 29/06

[52] U.S. Cl. ..... 401/50; 401/84; 401/107; 401/110; 401/111; 401/51

[58] Field of Search ..... 401/50, 51, 65, 66, 401/67, 82–84, 107, 110, 111, 92–94, 108

[56] References Cited

U.S. PATENT DOCUMENTS

| | | | |
|---|---|---|---|
| 465,057 | 12/1891 | Foley | 401/51 |
| 1,327,038 | 1/1920 | Hamilton | 401/51 |
| 1,382,047 | 6/1921 | Allsworth | 401/50 |
| 1,719,976 | 7/1929 | Grimmer | 401/51 |
| 1,849,914 | 3/1932 | Delvin | 401/51 |
| 2,512,208 | 6/1950 | Kuper | 401/51 |
| 2,680,426 | 6/1954 | Kohut | 401/51 |
| 3,039,436 | 6/1962 | Exner | 401/108 X |
| 3,399,945 | 9/1968 | Gouget | 401/50 |
| 3,850,531 | 11/1974 | Ackerman | 401/65 |

FOREIGN PATENT DOCUMENTS

| | | | |
|---|---|---|---|
| 302058 | 9/1954 | Switzerland | 401/51 |
| 19623 | of 1914 | United Kingdom | 401/83 |
| 679264 | 9/1952 | United Kingdom | 401/51 |

*Primary Examiner*—Steven A. Bratlie
*Attorney, Agent, or Firm*—Wood, Herron & Evans

[57] ABSTRACT

A disposable lead pencil, eraser and sharpener combination in which there is an eraser mounted upon one end of the housing and an abrasive sharpener structure contained within an enclosed and sealed chamber at the opposite end of the pencil housing. Sharpening of the lead is effected by reciprocating a pusher plate mounted upon the side of the housing back and forth to move the lead back and forth relative to the abrasive sharpener. At the end of each reciprocal stroke of the lead, an indexing mechanism automatically rotates the lead relative to the abrasive element so that a different section of lead is presented to the sharpener during each stroke. The sharpener containing chamber of the pencil housing is sealed so that all lead filings are retained within the pencil's housing.

18 Claims, 10 Drawing Figures

DISPOSABLE PENCIL STRUCTURE AND METHOD OF SHARPENING PENCIL HEAD

This application is a continuation-in-part of U.S. patent application Ser. No. 937,328, filed Aug. 28, 1978 now abandoned which is in turn a continuation-in-part of U.S. patent application Ser. No. 868,180, filed Jan. 9, 1978 now abandoned.

BACKGROUND OF THE INVENTION

This invention relates to pencil, eraser and sharpener combinations. More particularly, this invention relates to an improved disposable pencil, eraser, and sharpener structure, and to an improved method of using the sharpener to effect sharpening of a pencil lead.

In general, lead pencils may be classified as either disposable pencils or mechanical pencils. Disposable pencils are inexpensive pencils which are intended to be thrown away after the lead is consumed and typically include a lead core (or more commonly a graphite marking material contained in a binder) enclosed in a groove between two substantially semicylindrical wood casings cemented to form a unit. Such pencils usually have an eraser fixed at one end. These "wood case" lead pencils are sharpened to expose the lead, and after a number of sharpenings are consumed and must be thrown away as they have no further use. The advantage of disposable pencils is that they are inexpensive, very functional and easy to use. Mechanical pencils on the other hand are not disposable and are intended to use replaceable pencil leads. In these pencils, the lead is axially movable within the pencil body to expose the lead and after one lead is consumed, it is replaced by another. Such replaceable lead type mechanical pencils are generally not made disposable because the cost of manufacturing the pencil dictates that it be reusable with multiple replaceable lead if it is to be commercially feasible.

This invention is concerned with the disposable type pencils. Specifically, it has been the primary objective of this invention to provide a disposable type lead pencil which has all of the desirable physical and functional characteristics of a disposable pencil, but with the additional feature of a built-in pencil sharpener contained interiorly of the pencil body. Heretofore, all commercial disposable pencils of which we are aware have required auxiliary pencil sharpeners or sharpening devices for resharpening and exposing the lead of the pencil. It has been the primary objective of this invention therefore to build in the sharpener of a disposable pencil so as to eliminate the need for that auxiliary device.

Heretofore, there have been innumerable attempts to develop a pencil having a built-in sharpener, but so far as we are aware, all such attempts have involved the addition of a sharpener to a replaceable lead type mechanical pencil. The construction of these mechanical pencils, to which sharpeners were added, was always too complex and expensive to permit of their being disposable after consumption of a single lead contained within the pencil, and accordingly they were not designed for or ever intended to be disposable. But, it was in the area of disposable pencils where there was a need for a built-in sharpener. Accordingly, so far as we know, although there have been numerous attempts to create a pencil having a built-in sharpener, none of these attempts was ever commercially acceptable or met the need for a disposable pencil having a built-in sharpener.

The prior art built-in sharpener mechanical pencils of which we are aware suffered not only from being complex and expensive to manufacture, but they also suffered from the fact that most of them required very tight tolerances between the parts of the pencil, which tight tolerances also added to the expense of the product by precluding as a practical matter complete machine manufacture and assembly of the product.

Examples of prior art complex expensive mechanical pencils which have built-in sharpeners but which are too expensive and complex to be practical are found in U.S. Pat. Nos. 1,719,976 and 1,849,914, and British Pat. No. 679,264. In theory, these patents all appear to disclose practical self-sharpener mechanical pencils, but in practice the cost of manufacturing these mechanical pencils and the difficulty of manufacturing them in any appreciable volume with appropriate controls to assure operability preclude their practicality. Their designs also preclude their being manufactured and sold as disposable pencils.

Another common shortcoming of most prior art mechanical pencils has been the slowness with which they sharpen the pencil leads and the difficulty of using the sharpener. Many of these pencils rely upon withdrawal of the lead into the interior of the pencil and then rotation of the lead relative to the sharpener to effect the sharpening. This process is not only slow but is difficult to practice. Additionally, if the sharpener is an abrasive rather than a scraper, as for example in U.S. Pat. No. 1,327,038, the rotation of the abrasive sharpener relative to the lead cuts annular striations in the lead which very markedly reduces the strength of the lead and causes it to be easily broken when writing pressure is applied to it.

Another common shortcoming of very nearly all mechanical pencils of the type which includes a built-in sharpener is that they permit the filings to fall from the pencil onto the work surface or into the pockets or onto the hands of the person using the pencil. The above identified four patents are all subject to this shortcoming. One mechanical pencil which is not subject to this problem because of its provision of a seal around the sharpener of the pencil is Kohut U.S. Pat. No. 2,680,426. But, we have found that the seals of the Kohut patent create other problems. In the Kohut patent, the seals are disclosed as flat rubber or plastic washers. If those rubber washers or seals are sufficiently tight as to prevent leaking of the filings they will tend to break the lead and if loose, the filings will pass through the seal. Furthermore, we have found that flat rubber seals are ineffective as seals because the binder used in conventional leads is too abrasive to permit the lead to slip through a flat rubber seal without lead breakage if the seal is sufficiently tight to prevent leakage, and if the seal is made loose so as to avoid breakage of the lead, then it permits the lead filings to escape and create a cleanliness problem.

Accordingly, it has been another objective of this invention to provide a pencil having a built-in sharpener contained within a sealed chamber of the pencil from which the lead filings cannot escape.

It has been still a further objective of this invention to provide an improved disposable pencil, eraser and sharpener combination in which the lead sharpener is disposed within an enclosed sealed chamber such that filings cannot escape from the chamber either during sharpening or when the lead's writing end is moved forwardly into a writing attitude outside of the chamber. The construction of the sharpener and chamber are such that the chamber holds all of the lead filings for the full length of pencil lead without interference with the abrasive sharpening action. The only seals which we have found to be effective are those which have multiple spaced contact with the pencil lead such as sponge or foam rubber, or multiple stacked and spaced plys of resilient sealing material. We have further found that to be effective the seal must have the "memory" and resilient characteristic of latex rubber so as to fully and quickly close when the lead is withdrawn into the interior of the sealed chamber and yet maintain sealing contact with the lead when the lead is pushed forwardly through the seal.

Another objective of this invention has been to provide an improved disposable pencil eraser and sharpener structure incorporating a unique sharpener and an improved method for sharpening the lead of the pencil. In the practice of this method, the lead is initially retracted into the interior of the pencil and is then linearly and axially reciprocated relative to an abrasive sharpener with the abrasive having only longitudinal cutting contact with the pencil lead.

SUMMARY OF THE INVENTION

These objectives are accomplished by a combination pencil, eraser, and sharpener structure which comprises a molded plastic cylindrical housing within which a pencil lead is axially movable. Contained within a chamber of the housing is a spring biased abrasive sharpener, which when the end of the pencil lead is withdrawn into the chamber and is reciprocating relative to the abrasive, is effective to apply a generally conical point to the end of the lead. An indexing element secured to the lead is operative when contacted by a thumb latch, to effect automatic indexing of the lead relative to the abrasive sharpening element. The thumb latch in turn is operative to effect reciprocating movement of the lead as well as to lock the lead in an axially extending position after it has been sharpened.

Lead filings created by the sharpener of the lead are retained within the sharpening chamber of the pencil. To this end both ends of the sharpening chamber are sealed by a resilient sponge rubber or latex seal, preferably impregnated with a silicone grease such that filings cannot escape through the seal from the sharpening chamber.

The primary advantage of this invention is that it is so constructed as to be disposable and cost competitive with conventional wood case pencils. This competitiveness derives from its being designed so as to be capable of being machine manufactured and assembled from inexpensive molded plastic components in combination with a resilient diaphragm and an inexpensive leaf type spring having abrasive bonded to it. Alternatively, even the spring element may be formed from a plastic material. Consequently, the pencil of this invention may be manufactured at a price which renders it very competitive in the marketplace with the disposable pencil lacking the sharpener feature.

Another advantage of this invention derives from the fact that the pencil lead is sharpened as a consequence of longitudinal movement only relative to the abrasive sharpening element. Traditionally, pencil leads are sharpened by rotating them relative to a sharpening element with the result that if the sharpening is effected by an abrasive, the cutting lines or striations formed by the abrasive on the pencil lead extend circumferentially about the lead. These circumferential striations render the lead extremely brittle or weak at the location of each striation. The longitudinal striations formed on the surface of the lead by the practice of the method of this invention on the other hand, have no such weakening effect on the lead point and consequently the lead point is not nearly as susceptible to breakage as the lead points of pencil leads sharpened in the traditional manner.

Other objectives and advantages of this invention will be more apparent from the following detailed description taken in conjunction with the drawings in which.

Figure 1:
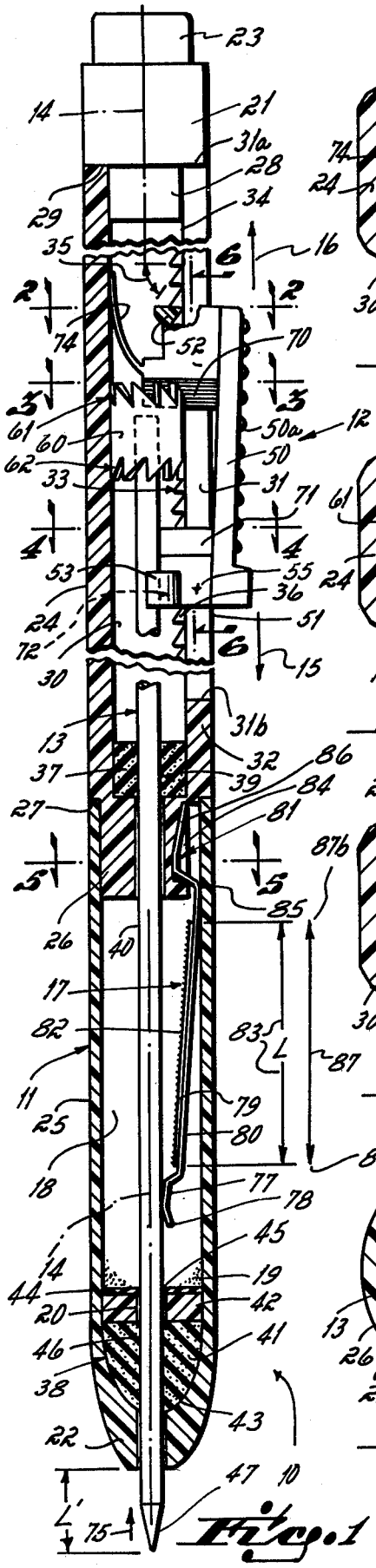
FIG. 1 is a longitudinal cross-sectional view taken axially of an improved mechanical pencil structure in accord with the principles of this invention, the lead's writing end being shown in an advanced or writing position.

A preferred embodiment of the improved pencil and sharpener structure in accord with the principles of this invention is particularly illustrated in FIGS. 1–7. As shown in FIG. 1, the improved mechanical pencil 10 basically includes a molded plastic housing 11, an advance and retract mechanism 12 that is engageable with lead 13 and is adapted to axially extend and advance that lead relative to the housing. The advance and retract mechanism 12 is structured to extend and retract the lead 13 axially and longitudinally of the housing's axis 14 (which is also the lead's axis), and is also structured to rotate the lead during both an extend stroke 15 and a return stroke 16. A sharpener 17 is carried within an enclosed chamber 18 defined in the housing, the enclosed chamber functioning to retain lead filings 19 after the lead has been sharpened.

The housing 11 is of a generally cylindrical plastic molded configuration, terminates at a writing end with a generally frustoconical tip 22, and terminates at the other end with an eraser 23 fixed to the housing, see FIG. 1. The housing 11 is comprised of an upper tubular section 24, and a lower tubular section 25, the upper section having a collar 26 adapted to seat as at 27 in the lower section, the upper and lower sections being fixed together in immobile relation at this point 27. The upper tubular section 24 is closed at the upper end by a fitting 21 that carries eraser 23. The fitting 21 includes a collar 28 that is seated in and immobily fixed to the housing 11 as at 29. Thus, the generally tubular housing 11 is comprised of an upper chamber 30 and a lower chamber 18.

Figure 8:
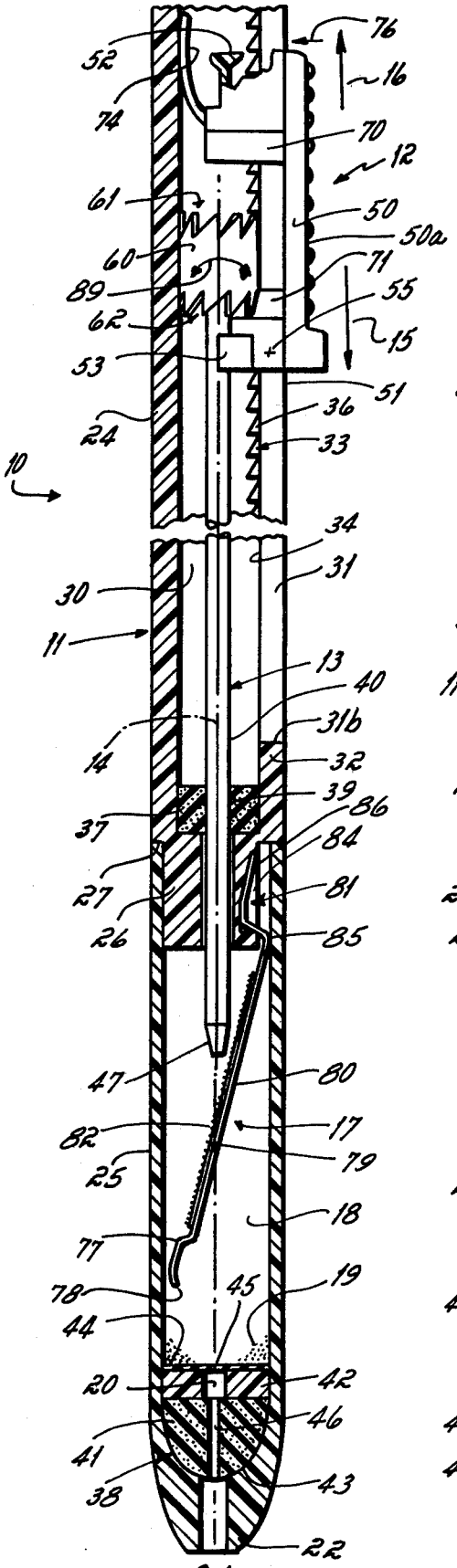
FIG. 8 is a view similar to FIG. 1, but illustrating the lead's writing end retracted and in an intermediate position of a sharpening stroke.
Figure 9:
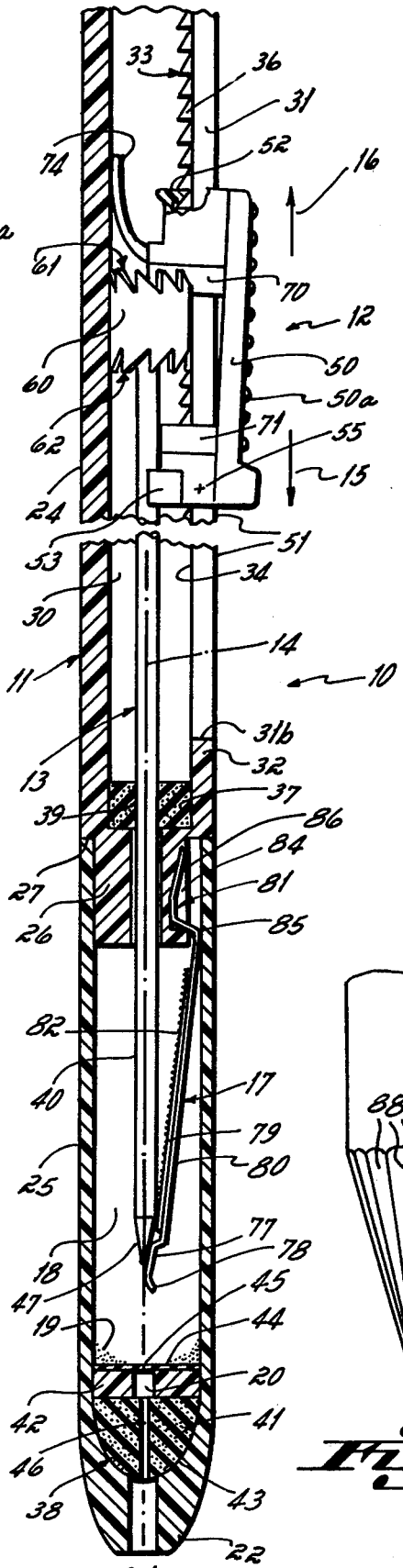
FIG. 9 is a view similar to FIG. 8, but showing the lead's writing end as it is extended from a sharpening position toward a writing position.

The housing's upper chamber 30 is opened to atmosphere through longitudinal slot 31 defined in the side wall 32 of the upper tubular section 24 between end stops 31*a*, 31*b*, see FIG. 1. The longitudinal slot 31 is parallel to axis 14 of the housing 11. A rack 33 is formed integral with the upper tubular section 24 parallel to and immediately adjacent to that slot 31 on the inside surface 34 of that upper tubular section 24, the lead angle 35 of the rack's teeth being directed generally downward as shown. The function of the rack 33 is explained in further detail below. The housing's lower chamber 18 is enclosed or sealed through use of an upper sponge rubber latex seal 37 friction fit in an immobile position in the bottom end of the upper chamber 30, and a lower sponge rubber latex seal 38 mounted adjacent the housing's tip 22 in the bottom end of the lower chamber 18. The upper seal 37 is a sponge rubber washer like seal that defines bore 39 therethrough sized to provide a very nominal clearance relative to outer surface 40 of the pencil lead 13. The upper seal's bore 39 clearance allows the lead 13 to be reciprocated therethrough. The lower seal 38 is comprised of a sponge rubber section 41, a rubber collar 42 friction fit in an immobile position to maintain the sponge rubber section 41 in seated relation with the generally conical seat 43 defined in the lower end of the chamber 18, and a flexible diaphragm 44 having a pinhole 45 centrally thereof, the pinhole being coaxially aligned with the pencil's axis 14. The rubber collar 42 defines bore 20 that is sized to permit reciprocation of lead 13 through it without hindrance, and the rubber section 41 defines bore 46 sized of a smaller diameter than lead 13 but sized to provide a wiping action on lead surface 40 as the lead reciprocates therethrough. The sponge rubber section 41 may be impregnated with a cleaning substance, e.g., a silicone grease, adapted to remove or wipe off substantially all traces of lead filings from the surface 40 of the lead 13 as it is advanced exteriorly of the housing (as shown in FIG. 1) after sharpening interiorly of the sharpening chamber 18 (as shown in FIGS. 8 and 9). The flexible diaphragm 44 at the lower end, and the rubber washer 37 at the upper end, of the lower chamber 18 cooperate with the walls of the housing's lower section 25 to define the enclosed sharpening chamber 18 interiorly of the pencil's housing 11. Of course, and because the sharpening chamber 18 is enclosed relative to atmosphere, lead filings 19 within the sharpening chamber, such as are generated during sharpening of the lead's writing end or point 47 through use of sharpener 17, are retained within that sharpening chamber and do not exhaust out onto a writing surface.

The advance and retract mechanism 12 for advancing the lead 13 exteriorly of the housing 11 into writing position, and for retracting the lead interiorly of the housing into sharpening position, is partially carried by the housing itself and partially carried by the lead, see FIGS. 1–4. The advance and retract mechanism 12 basically includes a manual operator or thumb latch 50 longitudinally slideable in housing slot 31 in both extend 15 and retract 16 directions through use of thumb force applied exteriorly of the housing 11, the operator plate 50 overlying the slot 31 so that the housing's exterior surface 51 adjacent the slot functions as a bearing surface over which the plate can slide. The pusher plate 50 provides a ribbed outer surface 50*a* adapted for manual engagement with a user's thumb. The operator plate 50 is connected with latch pawl 52 at the top end and with guide 53 at the lower end, both the pawl and guide being located interiorly of upper chamber 30 and being sized so that the operator plate 50 cannot be removed from the housing 11, see FIGS. 1, 2 and 4. Note the lateral distance D between guide 53 and plate 50 is only slightly greater than the thickness of the housing's wall 32, but that the lateral distance D′ between pawl 52 and plate 50 is substantially greater than the thickness of the housing's wall 32, thereby defining a pivot axis 55 for the operator plate adjacent the bottom end thereof, see FIG. 1, at all positions of the operator plate 50 relative to slot 31 between slot ends 31*a*, 31*b*. In use, it is engagement of certain elements, described in detail below and mounted to thumb latch or operator plate 50, with lead holder 60 that causes linear reciprocation 15, 16 of lead 13.

Figure 6:
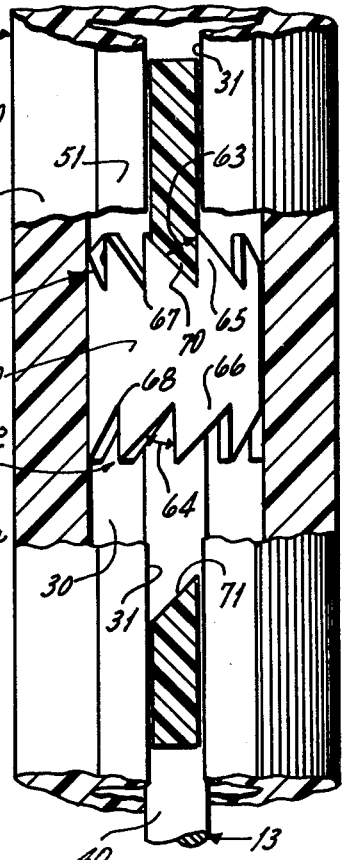
FIG. 6 is an enlarged cross-sectional view of a portion of the lead extend and retract mechanism taken along line 6—6 of FIG. 1, the structure being shown in a forward stroke position.
Figure 7:
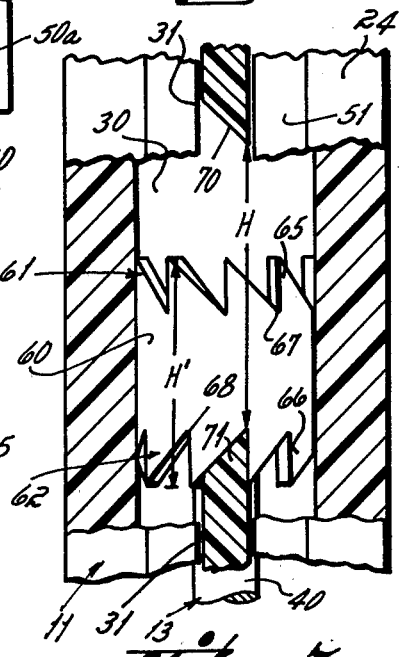
FIG. 7 is a view similar to FIG. 6 but illustrating the extend and retract mechanism in a rearward stroke position.

The advance and retract mechanism 12 includes certain structural elements which also cooperate to rotate the lead 13 a fraction of a complete turn in response to each longitudinal forward stroke 15 and each longitudinal reverse stroke 16 of an operator plate 50, thereby providing an automatic lead rotator or indexer means which functions in response to mere linear reciprocation of the advance and retract mechanism, see FIGS. 1, 6 and 7. This automatic lead rotator or indexer means includes a lead holder 60 fixed to the trailing end of the lead 13, the lead holder defining a first circular rack 61 on the top edge thereof and a second circular rack 62 on the bottom edge thereof. As illustrated in the drawings, each of the upper 61 and lower 62 racks have eight teeth, the upper and lower rack teeth being of the same size and configuration. Note particularly, as shown in FIGS. 6 and 7, that the lead angles 63, 64 of the teeth 65, 66 which define each respective rack 61, 62 open in the same direction for both the upper 61 and lower 62 racks. Note further, and importantly, that the bottom lands 67 of the teeth 65 of the upper rack 61 are located midway between the bottom lands 68 of the teeth 66 of the lower rack 62 when the racks are viewed from a line of sight normal to the plane of the teeth as in FIGS. 6 and 7. The lead holder 60 also functions to maintain axial alignment of the lead 13 relative to the housing's axis 14 since the outside diameter of the cylindrical lead holder is only nominally less than the inside diameter of the housing'is upper section 24.

Figure 2:
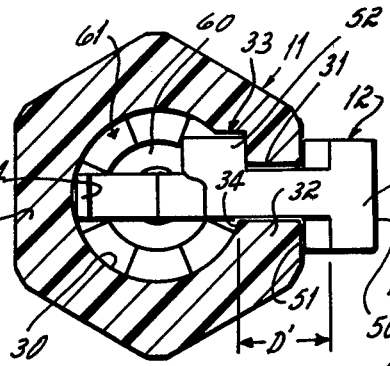
FIG. 2 is a cross-sectional view taken along line 2—2 of FIG. 1.
Figure 3:
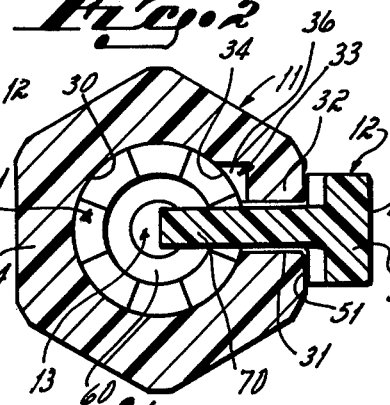
FIG. 3 is a cross-sectional view taken along line 3—3 of FIG. 1.
Figure 4:
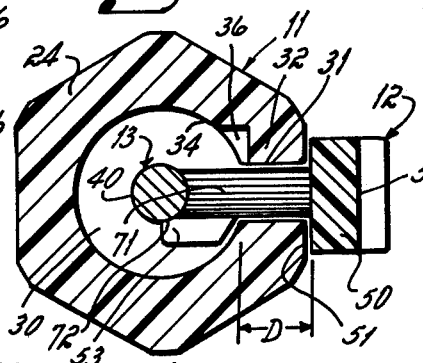
FIG. 4 is a cross-sectional view taken along line 4—4 of FIG. 1.

The operator plate 50 of the advance and retract mechanism 12 is formed integral with an upper cam 70 that extends radially into the housing's upper chamber 30, and the pusher plate 50 also is formed integral with a lower cam 71 that also extends radially into the housing's upper chamber, see FIGS. 1–4, 6 and 7. The upper 70 and lower 71 cams are spaced one from another a distance H somewhat greater than the height H′ of the lead holder 60, thereby permitting the upper cam to engage the upper rack 61 when the lower cam is disengaged from the lower rack 62, as shown in FIGS. 1 and 6, and vice-versa as shown in FIG. 7. The upper cam 70 also mounts the latch pawl 52 interiorly of the housing's upper chamber 30, that pawl being cooperatively engageable with the housing's fixed rack 33 as shown in FIGS. 1 and 2. The alignment guide 53 is mounted on the lower cam 71 interiorly of the housing's chamber 30, the alignment guide cooperating with the lead to provide a guide seat 72, and also cooperating with the pusher plate 50 to provice the pivot axis 55, see FIGS. 1 and 4.

The advance and retract mechanism 12 also includes a spring finger 74 that extends into sliding contact with a side wall portion of the housing's upper section 24 which is opposite to the slot 31 side wall portion. This spring finger 74 is connected at its other end to the pusher plate 50. In preferred form, and as is illustrated in the drawings, note particularly that the pusher plate 50, the upper 70 and lower 71 cams, the latch pawl 52, and the spring finger 74 are all formed integral in a one-piece configuration that may be easily manufactured from molded plastic. The spring 74 cooperates with the upper end of the pusher plate 50 to normally bias the pusher plate into the FIG. 1 attitude, i.e., clockwise relative to pivot axis 55 of the pusher plate. In this normally biased position, latch finger or pawl 52 is engaged or latched with the fixed rack 33 of the housing's upper section 24, thereby preventing further upward movement of lead 13 in the direction 16 when the lead holder 60 is engaged with the upper cam 70 as shown in FIG. 1. Hence, and when a force 75 is presented on the exposed writing end or point 47 of the lead 13, i.e., when the pencil is being used, the lead 13 will not retract further into the tubular housing 11 because of the spring 74 latched relation of the pusher plate's pawl 52 with the housing's fixed rack 33.

Figure 5:
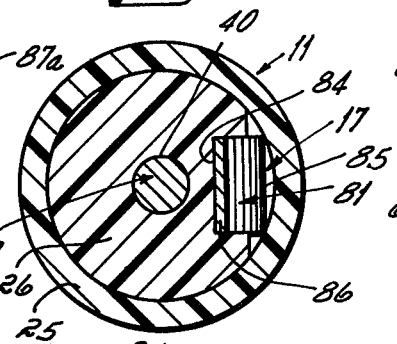
FIG. 5 is a cross-sectional view taken along line 5—5 of FIG. 1.

The sharpener 17, as illustrated in FIGS. 1 and 5, is comprised of a spring metal arm 80 having a connector end 81 by which it is trapped in a fixed position within the housing's lower chamber 18. The sharpener 17 is basically comprised of a strip of spring steel having an abrasive 82 coated onto the sharpening portion or length 83 thereof. Preferably the no-load abrasive is of a type that will not load up with graphite when the lead 13 is sharpened by being passed in a reciprocal path thereover. An example of a desirable abrasive 82 is an aluminum oxide abrasive coated on a paper backing 79, the paper backing itself being fixed, e.g., glued, to the spring arm 80. It will be apparent that the aluminum oxide grit could be coated directly onto the spring arm 80, thereby eliminating the paper backing, if desired. The connector end 81 of the spring arm 80 is of a generally dog legged configuration that includes knee 85 and leg 86, the leg 86 being partially received in a seat 84 defined in the collar 26 of the housing's upper section 24, thereby retaining the sharpener 17 in desired longitudinal position within the housing's lower chamber 18. The spring knee 85 of the sharpener arm 80 is such as to insure that the generally linear sharpener arm 80 is angled across the reciprocal path of the lead, i.e., across the housing's axis 14, as shown in FIG. 8, when the lead 13 is fully retracted into the pencil housing. The free or unconnected end 78 of the spring arm 80 is provided with a curved presser foot 77 that rides on the lead's surface 40 when the lead is in the writing position shown in FIG. 1, thereby preventing contact of the abrasive 82 with the lead's surface 40 when in that writing position.

General use of the preferred embodiment of the improved pencil structure 10 is particularly illustrated in FIGS. 1 and 6–9. When it is desired to partially extend or retract the pencil lead 13 so as to increase or decrease the length L′ of the lead point 47 exposed out of the pencil housing 11, the ratchet advance and retract mechanism 12 is employed. When it is desired to advance the lead 13 out of the housing 11, the pusher plate 50 need merely be pushed downwardly toward the housing's tip 22 in the direction shown by arrow 15, the pawl 52 easily moving up and over the fixed ratchet teeth 33, see FIGS. 1 and 9. This, of course, increases the length L′ of the exposed lead. When it is desired to retract the lead 13 into the housing 11 so as to shorten the length L′ of the lead extended beyond the housing's tip 22, a radially inward directed force (relative to the pusher plate's pivot axis 55) is directed on the top end of pusher plate 50 as illustrated by phantom arrow 76, thereby causing latch pawl 52 to pivot about axis 55 and to lift off the ratchet teeth 33 into the attitude shown in FIG. 8. In this attitude, and while retaining the pusher plate 50 in its inwardly pushed or FIG. 8 attitude, the user also exerts an upwardly directed force (as illustrated by phantom arrow 16) on the pusher plate so as to slide the pusher plate and pawl within the housing's slot 31 upwardly toward the eraser 23 in the same direction shown by that phantom arrow 16. With the pawl 52 so lifted out of the ratchet tooth rack 33, and with the upwardly 16 and inwardly 76 directed forces being simultaneously exerted on the pusher plate 50, the lead 13 is retracted in the direction shown by force arrow 16 so as to shorten the length L′ of the lead exposed. Thus, the ratchet advance and retract mechanism 12 functions to lengthen or shorten the length L′ of lead exposed beyond the housing's tip 22 as desired by the user.

When sharpening of the lead's point 47 is desired through use of the sharpener 17, the writing point end of the lead must be retracted interiorly of the pencil's housing 11 into the sharpener chamber 18, and into a position located rearwardly of the sharpener relative to the pencil's tip 22. This retraction, from the FIG. 1 to the FIG. 8 attitude, is accomplished by following the same before described steps for shortening exposed lead length L′. Complete retraction is achieved when the mechanisms's upper cam 70 bottoms out against top end **31*a* of the housing's slot 31. And when lead 13 is completely retracted, spring arm 80 springs abrasive 82 across the housing's axis 14, i.e., across the lead's reciprocal path, at a slight angle as shown in FIG. 8. Thereafter, the lead's writing end 47 is advanced into contact with the abrasive surface 82 of the sharpener 17 through use of the advance and retract mechanism 12. When in this initial contact position with the abrasive arm 80, as shown in FIG. 8, the pencil 10 is gripped in the palm of one hand, and the thumb of that hand is placed on the ribbed surface 50*a* of the pusher plate in a manner that allows the user's thumb to reciprocate the pusher plate 50 back and forth along the side of the pencil's housing 11 in a sharpening stroke 87 no greater in length L than the length 83 of the abrasive 82 coated arm 80, thereby manually introducing a linear sharpening stroke having a length L on the lead point 47. During this linear reciprocal sharpening stroke 87, the point 47 of the lead 13 is sanded against the abrasive 82 on the sharpener arm 80, thereby providing a somewhat flatted area 88 on the point, see FIG. 10. The forward stroke portion 87*a* of the reciprocal sharpening stroke 87 is caused by interengagement of the upper cam 70 with the lead holder's upper rack 61, thereby forcing the lead holder (and, hence, the lead 13 itself) in the forward direction shown by arrow 15. The return portion 87*b* of the sharpening stroke 87 is accomplished through abutting relation of the pusher plate's lower cam 71 with the lead holder's lower rack 62, thereby retracting the lead relative to the housing's tip 22. It will be understood that this is a manual longitudinal reciprocal motion 15, 16 introduced into the lead's writing end 47 through use of the advance and retract mechanism 12 which defines a sharpening stroke 87 about equal to the possible thumb stroke of a user when the pencil's housing 11** is held in the palm of one hand and gripped with the fingers of that same hand.

Figure 10:
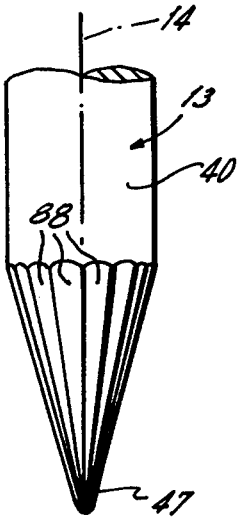
FIG. 10 is an enlarged view of a point produced on the lead by the sharpening method of this invention.

Importantly, however, and because of the operative relation of the upper 70 and lower 71 cams with the lead holder's upper 61 and lower 62 racks, on each forward stroke portion 87*a* of the sharpening stroke 87 (as established by interengagement of the upper cam 70 with the lead holder's upper rack 61) the lead holder 60 (and, hence, the lead 13 itself) is caused to rotate 1/16 of a turn because of the interengagement of that upper cam and a tooth 65 on that upper rack as shown in FIG. 6. Similarly, and on the return stroke portion 87*b* of the sharpening stroke 87, because of the interengagement of the lower cam 71 with a tooth 66 on the lead holder's lower rack 62, and because the lead angle 64 of the lower rack's teeth is the same as the lead angle 63 of the upper rack's teeth, a further 1/16 rotation of the lead in the same rotational direction is introduced into the lead. A 1/16 rotation only occurs because the upper rack's teeth 65 are offset midway of the lower rack's teeth 66, and because there are eight upper rack teeth and eight lower rack teeth. Thus, rotational motion 89 is induced in the lead 13 by the circular rack 61, 62, cam 70, 71 structure of the lead's advance and retract mechanism 12 during the manual longitudinal reciprocation of the pusher plate 50 by the pencil's user. This automatic rotational motion induced into the lead at the beginning of each of the forward 87*a* and return 87*b* stroke portions of the sharpening stroke 87 insures that the lead 13 will be relatively evenly sharpened into a generically conical point 47 after repeated sharpening strokes 87 have been carried out, the generally conical point 47 being comprised of a series of flatted areas 88 as shown in FIG. 10.

In practice, in the course of using the sharpener illustrated in the drawings of this application, the pencil lead is first caused to move upwardly as a consequence of movement of the pusher plate 50 to a position in which the lead is out of engagement with the abrasive sharpener as illustrated in FIG. 8. After having been moved upwardly to this extent, the direction of the pusher 50 is changed to a downward stroke. In the course of moving downwardly, the cam 70 of the pusher plate 50 moves down initially without any movement of the lead until the cam 70 engages one of the circular teeth 61 and causes the lead to rotate or index 1/16 of a turn. Thereafter, continued downward movement of the pusher 50 causes the lead holder 60 and the attached lead to move downwardly over the abrasive 82 on the sharpener arm 80 until the point of the lead engages the presser foot 77 (as illustrated in FIG. 9) and pushes the abrasive 82 away from and out of contact with the lead. Thereafter, and while the presser foot 77 remains engaged with the lead, the pusher plate is reversed in direction upwardly by the user. During initial movement of the pusher 50 upwardly, the cam 71 moves upwardly without any corresponding movement of the pencil lead and lead holder 60 until the cam 71 engages one of the teeth on the lower rack 62 and causes that lower rack 62 to rotate through 1/16 of a turn. During that rotation, the presser foot 77 maintains the abrasive 82 out of contact with the lead surface. Thereafter, continued upward movement of the pusher plate causes the lead holder 60 and lead to again move upwardly over the abrasive 82 as the lead moves off of the presser foot 77 into engagement with the abrasive. In no event is the lead ever rotated while in contact with the abrasive. The lead is either in an upward position out of contact with the abrasive as illustrated in FIG. 8, or has moved downwardly to such an extent so as to have engaged the presser foot 77 and pushed the abrasive 82 out of contact with the lead. Consequently, the abrasive never forms annular striations on the lead which would, if they ever occurred, cause the lead point to be weakened.

We have found that if the pusher plate 50 is ever "short-stroked" so that the lead is reciprocated through a very short distance, in which short distance it remains in contact with the abrasive, the lead does not rotate as a consequence of the cams 70, 71 engaging the teeth of the lead holder 60. Instead the abrasive 82 on the surface of the sharpener arm 80 remains in contact with previous striations and prevents the lead from rotating. The result of this "short stroking" is that the abrasive simply files a flat surface on the lead without permitting it to rotate. In practice, there is very little tendency to "short-stroke" the pusher plate 50 and lead since in the preferred embodiment, the diameter of the lead holder 60 is only ⅛" and the gap or distance between the cams 70, 71 (the distance between the lower surface of the cam 70 and the top surface of the cam 71) is only ¼". There is little or no tendency for the user of the pencil to reciprocate the pusher through less than ¼" stroke. Instead, the user generally strokes the pusher 50 through more than ½" of movement with the result that the lead is always disengaged from the abrasive 82 at each end of the stroke of the pusher 50 and is consequently free to index as a consequence of reversed movement of the pusher 50.

All lead filings 19 generated during sharpening of the lead's point 47 are retained in the housing's lower chamber 18 because of the flexible seal 44, 41 at the lower end thereof, and the rubber gasket seal 37 at the upper end thereof. Further, the sharpener chamber 18 remains closed to the atmosphere even when the lead 13 is in the writing attitude shown in FIG. 1 in that the seal resiliently grips the exterior surface 40 of the lead to prevent substantial lead filings 19 from passing therethrough. Any lead filings that might otherwise inadvertently pass therethrough are effectively wiped from the surface 40 of the lead 13 by the silicone grease impregnated sponge 41 seated in the lower end of the housing's lower chamber 18 as the lead is re-extended back into the writing position shown in FIG. 1.

We have found that the seal 41, to be effective must have multiple sequential or serially aligned spaced contact points with the lead if the filings are to be prevented from passing through the lower seal 41. Otherwise expressed, a single sheet type of rubber diaphram is ineffective for this purpose but a rubber foam or multiple spaced plys of sheet type diaphrams are effective if the multiple sheets are spaced so that a gap exists between the plys and the point at which they contact the lead. We have also found that the seal to be effective must be from a material which has the resilient memory characteristics of a latex rubber. Preferably the seal 41 as well as the seal 39 are made from a latex rubber foam.

After the user has sharpened the lead's point 47, the lead is extended from the sharpening chamber 18 back out into writing position shown in FIG. 1 simply by linearly moving the pusher plate 50 toward the tip 22 of the housing 11. This linear motion of the newly pointed lead 13 causes the spring arm 80 to be cammed out of sharpening relation with the lead itself, as is illustrated in FIG. 9. In other words, and when a conical point 47 is defined on the writing tip of the lead 13, the writing tip tends to ride over the sharpener's abrasive surface 82 and curved presser foot 77. This, in turn, causes the abrasive arm 80 to be automatically deflected out of its sharpening (i.e., angulated) alignment across the lead's axis 14 into a storage or non-sharpening attitude shown in FIG. 1 at which it bears against the side of the lead. In the sharpener 17 storage attitude, the abrasive arm 80 of the sharpener is sprung or deflected out of its sharpening attitude through action of sharpener arm 80 tending to pivot at knee 85. With the sharpener arm 80 biased radially outward (relative to the lead axis) beyond operative sharpening engagement with the lead, axial advancement motion of the lead may continue so as to extend or advance the lead's writing tip 47 outwardly beyond the pencil's tip 22 into the writing position shown in FIG. 1. Thus, the pencil lead 13 is automatically released from sharpening contact with the sharpener 17 itself when the user determines it is fully sharpened.

Having described the preferred embodiment of our invention, what we desire to claim and protect by Letters Patent is:

1. A disposable pencil comprising in combination
a generally tubular housing,
an eraser fixed to one end of said housing,
a pencil lead contained at least partially within said housing and axially movable therein,
an enclosed sharpening chamber at the opposite end of said housing from said eraser,
a sharpener contained within said sharpening chamber, said sharpener being radially movable between a sharpening position and a storage position relative to said lead in response to axial movement of said lead relative thereto,
means for sealing the opposite ends of said sharpening chamber so as to retain lead filings therein while still permitting one end of said lead to be retracted into said sharpening chamber for sharpening of said one end and then extended from said chamber to provide an exposed writing instrument at the end of said pencil, and
advance and retract mechanism including a spring biased pusher plate mounted upon one side of said housing, said pusher plate being spring biased outwardly into a locked position and upon being pushed inwardly against said spring bias, said mechanism being manually operable for moving said lead axially within said housing.

2. The disposable pencil and sharpener structure as set forth in claim 1 in which said advance and retract mechanism includes
rotator means for automatically rotating said lead a fraction of a turn in response to at least one of advancing any retracting movement of the writing end of said lead relative to said housing.

3. The disposable pencil of claim 1 in which said housing and said advance and retract mechanism are made exclusively from molded plastic components.

4. The disposable pencil as set forth in claim 1 wherein said sharpener includes an abrasive surface and means for continually spring biasing said abrasive surface toward said sharpening position, thereby causing said sharpener to be automatically located in said sharpening position when said lead is retracted into said housing and also permitting said sharpener to be located in said storage position after said lead has been fully sharpened.

5. The disposable pencil of claim 1 in which said sealing means comprises a resilient foam material.

6. The disposable pencil of claim 5 in which said resilient foam material is a latex rubber foam.

7. A disposable pencil comprising in combination
a generally tubular housing,
an eraser fixed to one end of said housing,
a pencil lead contained at least partially within said housing and axially movable therein,
an enclosed sharpening chamber at the opposite end of said housing from said eraser,
a sharpener contained within said sharpening chamber, said sharpener being radially movable between a sharpening position and a storage position relative to said lead in response to axial movement of said lead relative thereto,
means for sealing the opposite ends of said sharpening chamber so as to retain lead filings therein while still permitting one end of said lead to be retracted into said sharpening chamber for sharpening of said one end and then extended from said chamber to provide an exposed writing instrument at the end of said pencil,
advance and retract mechanism including a spring biased pusher plate mounted upon one side of said housing, said pusher plate being spring biased outwardly into a locked position and upon being pushed inwardly against said spring bias, said mechanism being manually operable for moving said lead axially within said housing, said pusher plate being manually slidable longitudinally of said housing,
a cam connected to said pusher plate, and
a circular rack connected to said lead, engagement of said cam with said circular rack causing said lead to rotate a partial turn.

8. The disposable pencil of claim 7 in which said housing and said advance and retract mechanism are all made of molded plastic components.

9. The disposable pencil of claim 8 in which said pusher plate has a spring molded therein for biasing said pusher plate radially outwardly toward a locked position.

10. The disposable pencil of claim 9 in which said pusher plate is engageable with a rack formed on said housing to lock said pusher plate and thereby said lead in a locked position relative to said housing.

11. A disposable pencil, eraser and sharpener combination comprising
a generally tubular housing, said housing defining a sharpening chamber at one end,
an eraser located at an opposite end of said housing,
a sharpener mounted within said sharpening chamber,
a pencil lead extending axially through said housing and through said sharpening chamber,
a lead holder permanently fixed to said lead and rotationally carried in said housing, said lead holder being structured to permit rotational movement of said lead relative to said housing,
a pusher mechanism slideably mounted on said housing, said pusher mechanism being structured to cooperate with said lead holder to permit advancement and retraction of said lead relative to said housing as desired by the user and yet prevent retraction of said lead when said pencil is being used for writing by the user, a closure structure to close that end of said sharpening chamber through which said lead is retracted and advanced, said closure structure being operable to substantially prevent lead filings from exhausting through that end of said sharpening chamber when said lead is being sharpened therein and when said lead is extended therefrom, and said lead holder comprising a circular rack and said pusher mechanism comprising a cam operationally engageable with said circular rack upon manual reciprocation of said pusher mechanism.

12. The combination as set forth in claim 11, said lead holder comprising upper and lower circular racks, and said pusher mechanism comprising upper and lower cams engageable with said respective upper and lower circular racks, thereby providing rotation of said lead in response to both extension and retraction strokes of said pusher mechanism.

13. The combination as set forth in claim 12, which further comprises a rack fixed to said housing, and a latch finger engageable with said rack to restrain said pusher mechanism and, thereby said lead, in a desired extended or retracted position.

14. The combination as set forth in claim 12, which further includes a ratchet tooth track defined in a wall of said housing, said ratchet tooth track being oriented generally parallel to the axis of said lead, and a latch finger connected to said pusher mechanism, said latch finger being spring biased continually into operational engagement with said ratchet tooth track, said latch finger and ratchet tooth track being structured to permit axial advancement of said lead towards said writing position from a retracted position while said latch finger and ratchet tooth track are engaged, but preventing retraction of said lead from said writing position to said retracted position while so engaged.

15. The combination of claim 14 in which said housing, said lead holder, and said pusher mechanism are all made of molded plastic.

16. The method of sharpening the lead of a mechanical pencil having a housing and an abrasive sharpener contained within the housing, said sharpener having an abrasive surface, which method comprises the steps of moving the writing end of the pencil lead axially within the housing and into contact with said abrasive sharpener, manually reciprocating the writing end of said lead back and forth relative to said sharpener in a direction coaxial with the axis of said lead while maintaining the writing end of said lead in contact with said abrasive sharpener, moving said lead out of contact with said abrasive surface at the end of each backward and each forward reciprocal stroke of said lead, indexing said lead at the end of each forward and backward reciprocal stroke of said lead relative to said abrasive surface when said lead is out of contact with said abrasive surface so as to form multiple flat surfaces in a generally conical surface configuration around the end of said lead with the conical surface having all cutting striations thereon extending longitudinally of said lead.

17. An improved method of sharpening the lead of a mechanical pencil having a housing and an abrasive sharpener contained within the housing, said sharpener having an abrasive surface, said method comprising the steps of moving the writing end of the pencil lead axially within the housing from the front of said sharpener to the rear of said sharpener, moving said sharpener to a sharpening position from a storage position in response to retraction of said lead's writing end past said sharpener, thereafter manually reciprocating said lead back and forth relative to said sharpener in a direction coaxial with the axis of said lead, moving said lead out of contact with said abrasive surface at the end of each backward and each forward reciprocal stroke of said lead, and automatically indexing said lead in response to said manual reciprocation only at the end of a forward and a backward reciprocal stroke of said lead relative to said abrasive sharpener when said lead is disengaged from said abrasive surface so as to establish a fully sharpened point on the writing end of said lead in which the cutting striations formed by said abrasive surface on said lead extend only longitudinally of said lead axis.

18. An improved method as set forth in claim 17 including the step of automatically indexing said lead relative to said sharpener at each end of said reciprocal stroke of said lead relative to said sharpener.

* * * * *